US008899530B2

(12) United States Patent
Hogan

(10) Patent No.: US 8,899,530 B2
(45) Date of Patent: Dec. 2, 2014

(54) TRAIN DIRECTION DETECTION VIA TRACK CIRCUITS

(71) Applicant: Siemens Industry, Inc., Alpharetta, GA (US)

(72) Inventor: Brian Hogan, Temecula, CA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 13/874,078

(22) Filed: Apr. 30, 2013

(65) Prior Publication Data

US 2014/0319286 A1 Oct. 30, 2014

(51) Int. Cl.
*B61L 23/34* (2006.01)
*B61L 1/18* (2006.01)
*B61L 1/00* (2006.01)

(52) U.S. Cl.
CPC .... *B61L 1/18* (2013.01); *B61L 1/00* (2013.01)
USPC ..... 246/122 R; 701/19

(58) Field of Classification Search
CPC ..... B61L 29/286; B61L 29/226; B61L 29/28; B61L 29/22; B61L 29/32; B61L 29/00; B61L 1/187; B61L 1/188; B61L 1/02; B61L 1/00; B61L 1/18; B61L 23/34
USPC ..... 246/111, 130, 122 R, 202, 208, 123, 246/124, 125, 220
See application file for complete search history.

(56) References Cited

U.S. PATENT DOCUMENTS

| | | | | |
|---|---|---|---|---|
| 5,170,970 | A * | 12/1992 | Ballinger | 246/34 R |
| 5,868,360 | A * | 2/1999 | Bader et al. | 246/202 |
| 6,292,112 | B1 * | 9/2001 | Bader et al. | 340/941 |
| 6,604,031 | B2 * | 8/2003 | Oguma et al. | 701/19 |
| 7,254,467 | B2 * | 8/2007 | Fries et al. | 701/19 |
| 7,975,968 | B2 * | 7/2011 | Bohlmann et al. | 246/122 R |
| 8,157,219 | B2 * | 4/2012 | Ashraf et al. | 246/130 |
| 8,297,558 | B2 * | 10/2012 | O'Dell et al. | 246/126 |
| 8,500,071 | B2 * | 8/2013 | O'Dell | 246/293 |
| 8,515,697 | B2 * | 8/2013 | Alexander et al. | 702/58 |
| 8,517,316 | B2 * | 8/2013 | Baldwin et al. | 246/130 |
| 8,590,844 | B2 * | 11/2013 | Hogan | 246/34 B |
| 2004/0181321 | A1 * | 9/2004 | Fries et al. | 701/19 |
| 2008/0169385 | A1 * | 7/2008 | Ashraf et al. | 246/130 |
| 2010/0108823 | A1 * | 5/2010 | Barnes | 246/111 |
| 2011/0011985 | A1 * | 1/2011 | Hogan | 246/34 R |
| 2011/0174934 | A1 * | 7/2011 | Kikuchi et al. | 246/122 R |
| 2012/0181390 | A1 * | 7/2012 | Ashraf et al. | 246/122 R |
| 2013/0062474 | A1 * | 3/2013 | Baldwin et al. | 246/122 R |
| 2013/0248658 | A1 * | 9/2013 | Takagi | 246/122 R |
| 2013/0299645 | A1 * | 11/2013 | Cooper et al. | 246/122 R |

FOREIGN PATENT DOCUMENTS

WO WO 2004/076256 9/2004

* cited by examiner

*Primary Examiner* — Jason C Smith

(57) ABSTRACT

Track circuits and constant warning time devices that can make train direction determinations using multi-frequency track impedance measurements and combinations of frequency tuned shunts.

22 Claims, 3 Drawing Sheets

TRAIN DIRECTION DETECTION VIA TRACK CIRCUITS

FIELD

Embodiments of the invention relate to railroad constant warning time devices and, more particularly, to a constant warning time device using a multi-frequency train detection process.

BACKGROUND

A constant warning time device (often referred to as a crossing predictor or a grade crossing predictor in the U.S., or a level crossing predictor in the U.K.) is an electronic device that is connected to the rails of a railroad track and is configured to detect the presence of an approaching train and determine its speed and distance from a crossing (i.e., a location at which the tracks cross a road, sidewalk or other surface used by ironing objects). The constant warning time device will use this information to generate a constant warning time signal for controlling a crossing warning device. A crossing warning device is a device that warns of the approach of a train at a crossing, examples of which include crossing gate arms (e.g., the familiar black and white striped wooden arms often found at highway grade crossings to warn motorists of an approaching train), crossing lights (such as the red flashing lights often found at highway grade crossings in conjunction with the crossing gate arms discussed above), and/or crossing bells or other audio alarm devices. Constant warning time devices are often (but not always) configured to activate the crossing warning device at a fixed time (e.g., 30 seconds) prior to an approaching train arriving at a crossing.

Typical constant warning time devices include a transmitter that transmits a signal over a circuit formed by the track's rails and one or more termination shunts positioned at desired approach distances from the transmitter, a receiver that detects one or more resulting signal characteristics, and a logic circuit such as a microprocessor or hardwired logic that detects the presence of a train and determines its speed and distance from the crossing. The approach distance depends on the maximum allowable speed of a train, the desired warning time, and a safety factor. Preferred embodiments of constant warning time devices generate and transmit a constant current AC signal on said track circuit; constant warning time devices detect a train and determine its distance and speed by measuring impedance changes caused by the train's wheels and axles acting as a shunt across the rails, which effectively shortens the length (and hence lowers the impedance) of the rails in the circuit. Multiple constant warning devices can monitor a given track circuit if each device measures track impedance at a different frequency. Measurement frequencies are chosen such that they have a low probability of interfering with each other while also avoiding power line harmonics.

Federal regulations mandate that a constant warning time device be capable of detecting the presence of a train as it approaches a crossing and to activate the crossing warning devices in a timely manner that is suitable for the train speed and its distance from the crossing. In addition, the device must be capable of detecting trains that approach the crossing from both sides of the crossing (e.g., from east to west and from west to east, north to south and south to north, etc.).

One way to achieve this is to use two uni-directional track circuits, one that detects the presence of the train approaching from a first direction and one that detects the presence of the train approaching from a second direction. Uni-directional track circuits often employ insulated track joints. An insulated track joint requires the rails to be physically cut. Since the rails on either side of these cuts are required to be aligned to prevent derailment and other problems, insulated track joints require additional maintenance and monitoring, which is undesirable.

Although bi-directional track circuits can detect the direction of approaching trains from both sides of the crossing, they often require extra signaling or calculations, which is also undesirable. Thus, there is a need and desire for a fast and reliable technique fir determining the direction of a train travelling along a railroad track.

DETAILED DESCRIPTION

Figure 1:
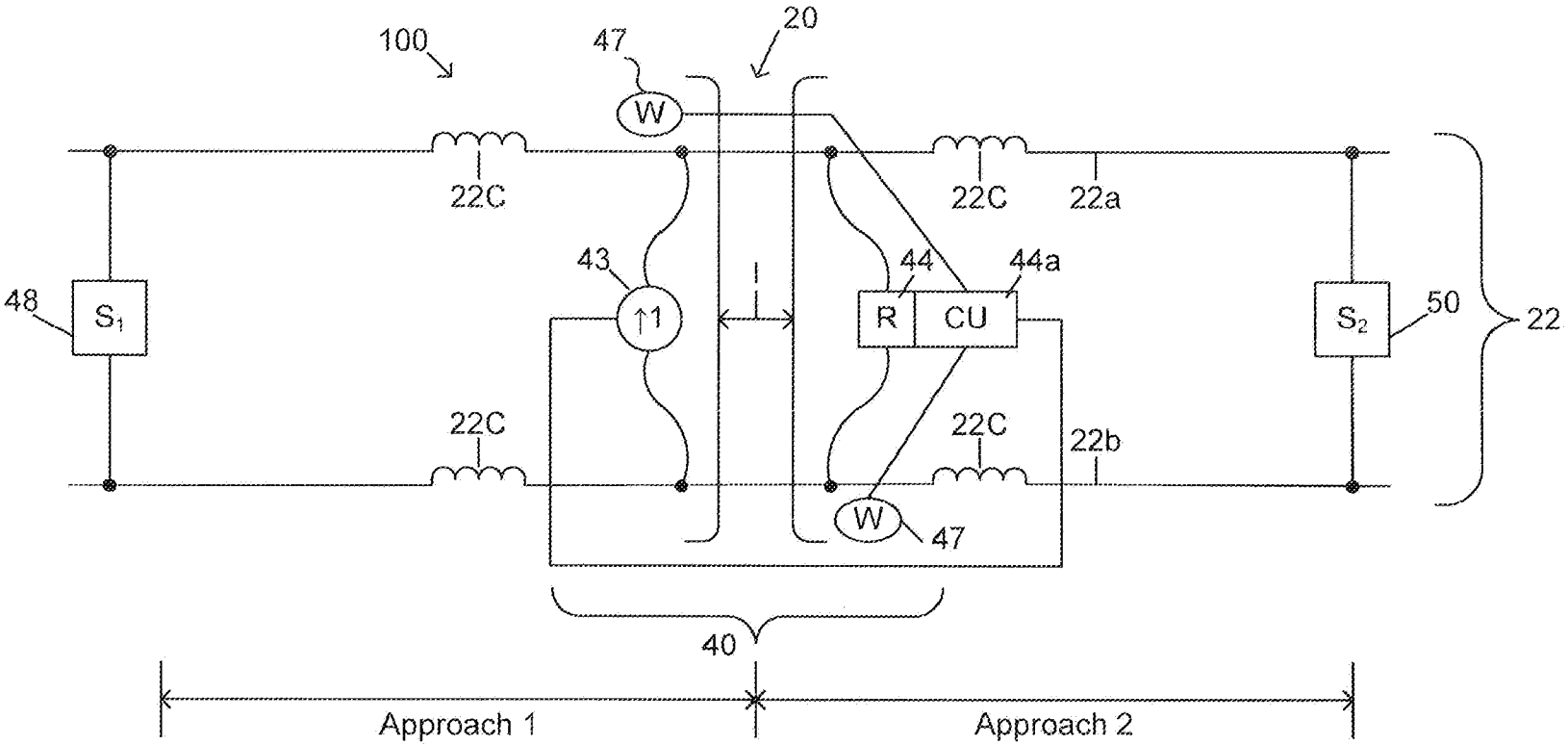
FIG. 1 illustrates a circuit diagram of an example track circuit in accordance with an embodiment disclosed herein.

FIG. 1 illustrates a track circuit 100 in accordance with a disclosed embodiment. The track circuit 100 is a bi-directional track circuit. The track circuit 100 is provided at a location in which a road 20 crosses a railroad track 22. The railroad track 22 includes two rails 22*a*, 22*b* and a plurality of ties (not shown in FIG. 1) that are provided over and within railroad ballast to support the rails. The rails 22*a*, 22*b* are shown as including inductors 22*c*. The inductors 22*c*, however, are not separate physical devices but rather are shown to illustrate the inherent distributed inductance of the rails 22*a*, 22*b*.

The track circuit 100 includes a constant warning time device 40 that comprises a transmitter 43 connected across the rails 22*a*. 22*b* on one side of the road 20 and a receiver 44 connected across the rails 22*a*, 22*b* on the other side of the road 20. Although the transmitter 43 and receiver 44 are connected on opposite sides of the road 20, those of skill in the art will recognize that the components of the transmitter 43 and receiver 44 other than the physical conductors that connect to the track 22 are often co-located in an enclosure located on one side of the road 20. The transmitter 43 and receiver 44 are also connected to a control unit 44*a*, which is also often located in the aforementioned enclosure. The control unit 44*a* is connected to and includes logic, for controlling warning devices 47 at the crossing of the road 20 and the track 22. The control unit 44*a* also includes logic (which may be implemented in hardware, software, or a combination thereof) for calculating train speed, distance and direction, and producing constant warning time signals for its crossing.

Also shown in FIG. 1 are a pair of termination shunts 48, 50, one on each side of the road 20 at a desired approach distance (e.g., 3000 feet). Thus, the rails 22*a*. 22*b* on each side of the road 20 have first and second approach areas respectively defined by the first and second shunts 48, 50, in the illustrated embodiment, the shunts 48, 50 are frequency tuned AC circuits configured to shunt one or more particular frequencies being transmitted by the transmitter 43 (as discussed below). An example of a frequency selectable shunt is disclosed in U.S. Pat. No. 5,029,780, the entire contents of which are hereby incorporated herein by reference.

Typically, in existing track circuits, the shunts positioned on both sides of the road and their associated constant warning time device are tuned to the same frequency. This way, the transmitter can continuously transmit one AC signal having one frequency, the receiver can measure the voltage response of the rails and the control unit can make impedance and constant warning time determinations based on one specific frequency. When a train crosses one of the termination shunts, the train's wheels and axles act as shunts, which lowers the inductance, impedance and voltage measured by the corresponding control unit. Measuring the change in the impedance indicates the distance of the train, and measuring the rate of change of the impedance (or integrating the impedance over time) allows the speed of the train to be determined. The known constant warning time devices can determine direction by monitoring the change in impedance. For example, as a train moves toward the device, the measured impedance will decrease, whereas the impedance will increase as the train moves away from the device. As noted above, there is a need for a better, faster and more reliable technique for determining train direction, particularly on a bi-directional track circuit.

The disclosed embodiments utilize the principle that an approaching train's wheels provide a non-frequency specific or broadband shunt to the rails 22*a*, 22*b*. That is, once the train is in an approach, all frequencies are shunted via the train's wheels. This is why multiple primary frequencies can be generated by different constant warning time devices to measure the same track's impedance. Normally, a single constant warning time device would operate based on one frequency, which has the afore-mentioned shortcomings. In the embodiments disclosed herein, the constant warning time device 40 will use two different frequencies (e.g., first and second frequencies) and different frequency tuned shunts, one on a first side of the road 20 and another on a second side of the road 20, to determine which side of the road 20 the train is approaching from. Train detection determinations will be made using two AC signals, one having the first frequency and one having the second frequency. The frequencies will be selected in accordance with the criteria that there must be no interference with other track signals (including other primary and supplemental track circuit frequencies), in one embodiment, the frequencies can be set by train or maintenance personnel, or any other user of the track circuit 100. As will be explained below in more detail, detecting impedance behavior associated with the different frequencies allows for a quick and accurate way to determine which side of the road 20 the train is approaching from.

In accordance with the disclosed principles, the first shunt 48 is a multi-frequency shunt tuned to two specific frequencies (e.g., the first and second frequencies). The second shunt 50, on the other hand, is tuned to only one of the first or second frequencies. For example purposes only, the second shunt 50 is described in the following description as being tuned to the first frequency, but it should be appreciated that it could be tuned to the second frequency if desired. The shunts 48, 50 can comprise passive components (e.g., capacitors and inductors) that are configured for their respective frequency/frequencies or they can be programmable shunts that are programmed to the appropriate frequency/frequencies, such as the shunts disclosed in U.S. application Ser. No. 13/836,459, filed on Mar. 15, 2013, entitled "Wireless and/or Wired Frequency Programmable Termination Shunts," which is hereby incorporated by reference in its entirety.

In accordance with the disclosed principles, the transmitter 43 is configured to transmit two constant current AC signals. The first signal will have the first frequency, corresponding to one of the frequencies of the first frequency tuned shunt 48 and the lone frequency of the second tuned shunt 50, while the second signal will have the second frequency, corresponding to the second frequency of the first tuned shunt 48. Typically, the first and second frequencies will be in the audio frequency range, such as e.g., 50 Hz-1000 Hz, but it should be appreciated that any suitable frequency can be used for the first and second frequencies. Likewise, the receiver 44 will be configured to detect signals based on the first and second frequencies. For example, the receiver 44 can include multiple signal processors, with each processor capable of detecting a respective signal frequency. The receiver 44 will measure the voltage across the rails 22*a*, 22*b*, which (because the transmitter 43 generates constant current AC signals) is indicative of the impedance and hence the inductance of the circuit formed by the rails 22*a*, 22*b* and shunts 48, 50. The control unit 44*a* will determine, among other things, the direction of the train based on these impedance measurements in the manner explained below.

When a train approaches from the side of the road 20 having the first tuned shunt 48 (i.e., it enters approach 1), the first and second frequencies will exhibit the same impedance behavior. That is, when the train approaches from the side of the road having tuned shunt 48, the first and second frequencies will exhibit decreasing signal levels simultaneously (although their slopes will differ based on the fact that the first signal is terminated at both ends by the train axles and opposite end shunt, and the second signal is terminated by the train axles alone). If the control unit 44*a* detects this behavior, it determines that the train is travelling from approach 1 towards the road 20. On the other hand, if a train approaches from the side of the road 20 having the second tuned shunt 50 (i.e., it enters approach 2), the first and second frequencies will exhibit different impedance behavior because the second frequency propagates beyond the shunt 50 and therefore will be affected by it (i.e., train axle shunting); in contrast, the first frequency will not be affected until the train axle crosses over shunt 50 into approach 2. If the control unit 44*a* detects this behavior, it determines that the train is travelling from approach 2 towards the road 20. Thus, by monitoring the impedance behavior of the rails 22*a*, 22*b* based on the first and second frequencies, train direction can be determined in a quick and accurate manner and without complicated calculations or continued monitoring of the rail response. In addition, measuring the change in the impedance indicates the distance of the train, and measuring the rate of change of the impedance (or integrating the impedance over time) allows the speed of the train to be determined.

Figure 2:
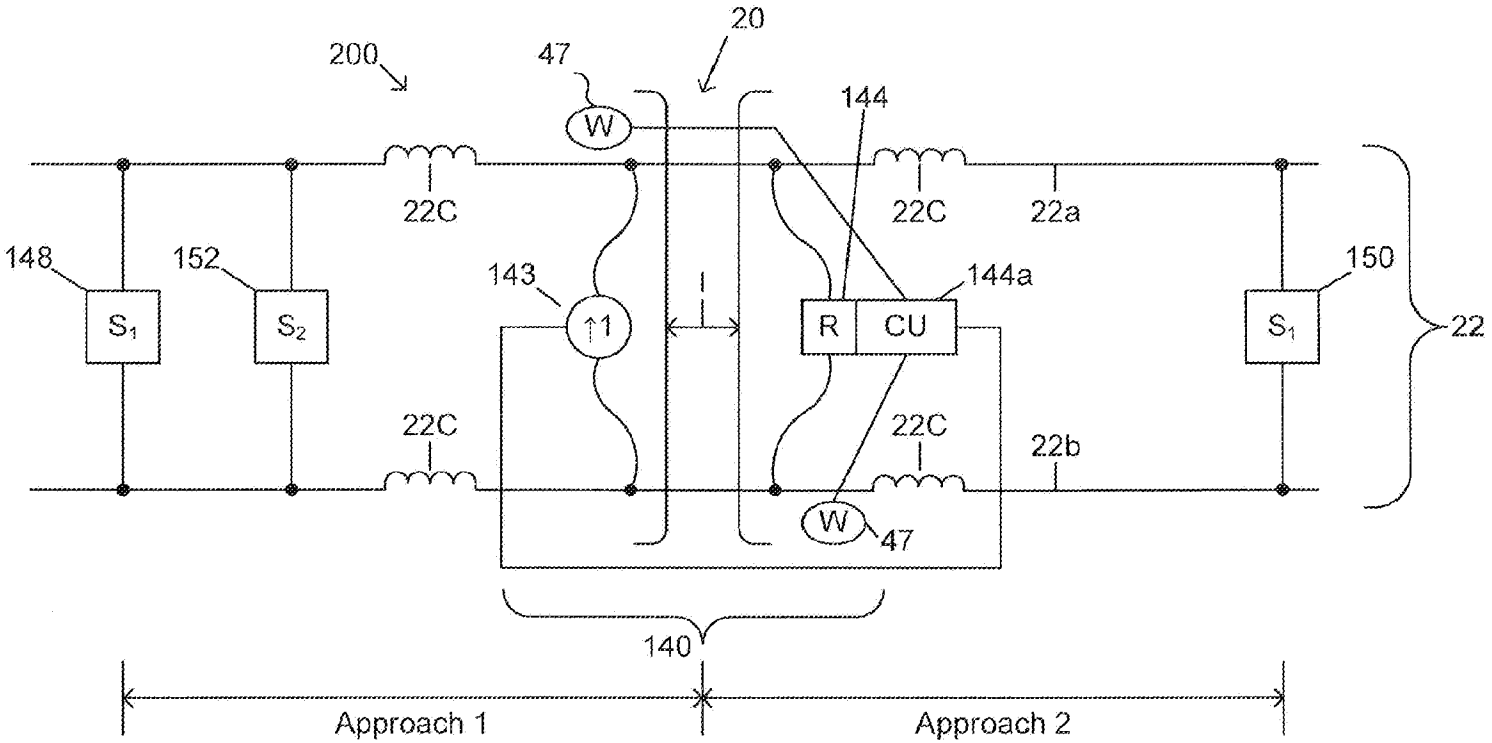
FIG. 2 illustrates a circuit diagram of another example track circuit in accordance with another embodiment disclosed herein.

FIG. 2 illustrates a track circuit 200 in accordance with another disclosed embodiment. The track circuit 200 is a bi-directional track circuit. Like elements from the FIG. 1 circuit 100 contain the same reference numerals in FIG. 2 and are not discussed further with respect to FIG. 2.

The track circuit 200 includes a constant warning time device 140 that comprises a transmitter 143 connected across the rails 22*a*, 22*b* on one side of the road 20 and a receiver 144 connected across the rails 22*a*. 22*b* on the other side of the road 20. Although the transmitter 143 and receiver 144 are connected on opposite sides of the road 20, those of skill in the art will recognize that the components of the transmitter 143 and receiver 14 other than the physical conductors that connect to the track 22 are often co-located in an enclosure located on one side of the road 20. The transmitter 143 and receiver 144 are also connected to a control unit 144*a*, which is also often located in the aforementioned enclosure. The control unit 144*a* is connected to and includes logic for controlling warning devices 47 at the crossing of the road 20 and the track 22. The control unit 144*a* also includes logic (which may be implemented in hardware, software, or a combination thereof) for calculating train speed, distance and direction, and producing constant warning time signals for its crossing.

In the illustrated embodiment, there are three frequency tuned shunts 148, 150, 152 connected across the rails 22*a*, 22*b*. According to this embodiment, the first and second shunts 148, 150 are connected at an approach distance (e.g., 3000 feet) respectively defining first and second approach areas. The third shunt 152 is located somewhere between the first shunt 148 and the road 20. In one embodiment, the third shunt 152 is located anywhere between 1000 and 2000 feet away from the road 20. It should be appreciated, however, that the exact location of the third shunt 152 is not limited and that it only needs to be somewhere in the first approach area defined by the first shunt 148. In the illustrated embodiment, the shunts 148, 150, 152 are frequency tuned AC circuits configured to shunt one or more particular frequencies being transmitted by the transmitter 143 (as discussed below).

In accordance with the disclosed principles, the first shunt 148 is tuned to a first specific frequency and the third shunt 152 is tuned to a second, different specific frequency. The second shunt 150 is a multi-frequency shunt tuned to both the first and second frequencies. As with the shunts 48, 50 discussed above with reference to FIG. 1, shunts 148, 150 and 152 can comprise passive components (e.g., capacitors and inductors) that are configured for their respective frequency/frequencies or they can be programmable shunts that are programmed to the appropriate frequency/frequencies.

In accordance with the disclosed principles, the transmitter 143 is configured to transmit two constant current AC signals. The first signal will have the first frequency, corresponding to one of the frequencies of the second shunt 150 and the lone frequency of the first shunt 148, while the second signal will have the second frequency, corresponding to a second one of the frequencies of the second shunt 150 and the lone frequency of the third shunt 152. As with other embodiments disclosed herein, the first and second frequencies can be in the audio frequency range, such as e.g., 50 Hz-1000 Hz, but may be any suitable frequency. The receiver 144 will be configured to detect signals based on the first and second frequencies. For example, the receiver 144 can include multiple signal processors, with each processor capable of detecting a respective signal frequency. The receiver 144 will measure the voltage across the rails 22*a*, 22*b*, which is indicative of the impedance and the inductance of the circuit formed by the rails 22*a*, 22*b* and shunts 148, 150, 152. The control unit 144*a* will determine, among other things, the direction of the train based on these impedance measurements in the manner explained below.

When a train approaches from the side of the road 20 having the second tuned shunt 150 (i.e., it enters approach 2), the first and second frequencies will exhibit the same impedance behavior. If the control unit 144*a* detects this behavior, it determines that the train is travelling from approach 2 towards the road 20. By contrast, if a train approaches from the side of the road 20 having the first and third shunts 148, 152 (i.e., it enters approach 1), the first and second frequencies will exhibit different impedance behavior because the first frequency will be shunted before the second frequency is shunted due to the separation of the first and third shunts 148, 152. If the control unit 144*a* detects this behavior, it determines that the train is travelling from approach 1 towards the road 20. Thus, by monitoring the impedance behavior of the rails 22*a*, 22*b* based on the first and second frequencies, train direction can be determined in a quick and accurate manner and without complicated calculations or continued monitoring of the rail response. In addition, measuring the change in the impedance indicates the distance of the train, and measuring the rate of change of the impedance or integrating the impedance over time) allows the speed of the train to be determined.

Although not illustrated, the principles of the FIG. 2 embodiment can be applied using an adjacent or nearby track circuit as one of the first or third shunts and the frequency of that track circuit as one of the frequencies. For example, if there is a nearby or adjacent track circuit with its own termination shunt positioned between the first shunt 148 and the road 20, the termination shunt from the nearby or adjacent circuit can be used as the third shunt 152, which is tuned to a different frequency than the first shunt 148. The second shunt 150 would be tuned to a first frequency transmitted by the constant warning time device 140 of circuit 200, which is also the frequency of the first shunt 148, and a second frequency transmitted by the constant warning time device of the nearby/adjacent track circuit.

Likewise, if the nearby/adjacent track circuit has a termination shunt positioned outside of the first approach area, the termination shunt from the nearby/adjacent circuit can be used as the first shunt 148, which would have a different frequency than the third shunt 152. The second shunt 150 would be tuned to a first frequency transmitted by the constant warning time device 140 of circuit 200, which is also the frequency of the third shunt 152, and a second frequency transmitted by the constant warning time device of the nearby/adjacent track circuit. These scenarios are possible because the nearby/adjacent track circuit must necessarily use a different frequency than the frequency used by circuit 200, otherwise the circuits would interfere with each other, in this alternative embodiment, the transmitter 143 need only transmit one AC signal with either the first or second frequency, depending on the scenario, since the second signal with the other frequency is being transmitted by the nearby/adjacent rack circuit. The receiver 144, on the other hand, must still be capable of measuring signals based on both frequencies and the control unit 144*a* will still make train direction determinations as set forth above. As such, this alternative will use less shunt circuitry than the embodiment illustrated in FIG. 2 and will use a simplified transmitter as it only needs to transmit one AC signal.

Figure 3:
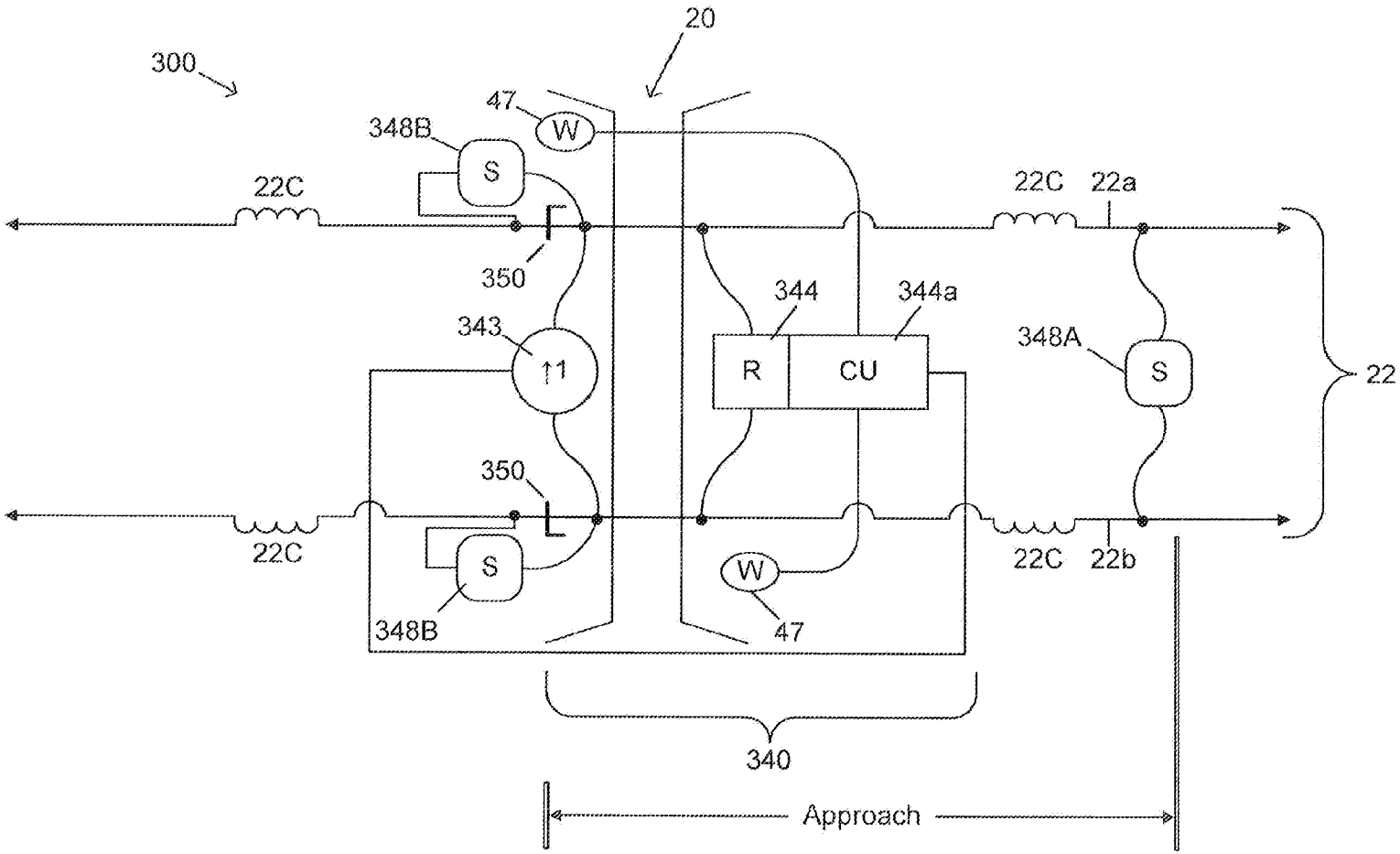
FIG. 3 illustrates a circuit diagram of another example track circuit in accordance with yet another embodiment disclosed herein.

The disclosed principles could be implemented on a track circuit 300 that uses insulated joints 350, such as the circuit 300 illustrated in FIG. 3. Typically, insulated joints provide train direction indication by virtue of a step change in impedance as the train crosses over the insulated joint. This technique would only use one frequency impedance measurement. The technique, however, can be improved using a multi-frequency impedance measurement technique in accordance with the disclosed principles. That is, two frequencies can transmitted along the rails 22*a*, 22*b*, a first frequency corresponding to a tuned frequency shunt 348A positioned at a typical shunting location defining an approach area, and a second frequency corresponding to additional tuned frequency shunts 348B that are used to bypass the insulated joint 350 for the second frequency.

A constant warning time device 340 having a transmitter 343, a receiver 344 and a control unit 344*a* is also connected to the rails 22*a*. 22*b* in a manner similar to the other embodiments disclosed herein. In accordance with the disclosed principles, the transmitter 343 is configured to transmit two constant current AC signals. The first signal will have the first frequency, corresponding to the frequencies of the first shunt 348A, and the second signal will have the second frequency, corresponding to the bypass shunts 348B. As with other embodiments disclosed herein, the first and second frequencies can be in the audio frequency range, such as e.g., 50 Hz-1000 Hz, but may be any suitable frequency. The receiver 344 will be configured to detect signals based on the first and second frequencies and can be configured as described above for the other disclosed embodiments. The receiver 344 will measure the voltage across the rails 22*a*, 22*b*. The control unit 344*a* will mike an earlier train direction determination, among other things, based on these impedance measurements. That is, the bypassed second frequency will show impedance changes due to the shunting action of the train prior to the insulated joint 350 versus the non-bypassed frequency associated with termination shunt 348A.

The disclosed embodiments provide several advantages over existing track circuits and constant warning time devices. For example, and as mentioned above, train direction detection can be determined in a more reliable, faster and accurate manner. Federally mandated automated maintenance and other regulations can be implemented and satisfied since train movements and associated warning times for both approach directions can be demonstrated and reported quite easily.

The foregoing examples are provided merely for the purpose of explanation and are in no way to be construed as limiting. Further areas of applicability of the present disclosure will become apparent from the detailed description, drawings and claims provided hereinafter. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

Additionally, the purpose of the Abstract is to enable the patent office and the public generally, and especially the scientists, engineers and practitioners in the art who are not familiar with patent or legal terms or phraseology, to determine quickly from a cursory inspection the nature of the technical disclosure of the application. The Abstract is not intended to be limiting as to the scope of the present inventions in any way.

What is claimed is:

1. A method of detecting a direction of travel of a train on rails of a railroad track, said method comprising: comparing a characteristic of the rails based on a first frequency to the characteristic of the rails based on a second frequency to generate a comparison result, the first frequency being different than the second frequency; and determining the direction of travel of the train based on the comparison result, further comprising: providing a first shunt at a first location along the rails, the first shunt being tuned to the first frequency and the second frequency; providing a second shunt at a second location along the rails, the second shunt being tuned to the first frequency, the first and second locations being on a respective side of a third location; transmitting along the rails a first signal having the first frequency and a second signal having the second frequency; measuring an impedance of the rails in relation to the first frequency; and measuring impedance of the rails in relation to the second frequency.

2. The method of claim 1, wherein the direction of travel corresponds to a first direction if the comparison result indicates that the characteristic of the rails based on the first frequency behaves similarly to the characteristic of the rails based on the second frequency.

3. The method of claim 2, wherein the direction of travel corresponds to a second direction if the comparison result indicates that the characteristic of the rails based on the first frequency is different than the characteristic of the rails based on the second frequency.

4. The method of claim 1, wherein the characteristic of the rails is an impedance of the rails.

5. The method of claim 1, wherein said determining step comprises determining that the train is travelling in the direction from the first location towards the third location if the impedance of the rails based on the first frequency is substantially similar to the impedance of the rails based on the second frequency, and that the train is travelling in the direction from the second location towards the third location if the impedance of the rails based on the first frequency is different than the impedance of the rails based on the second frequency.

6. A method of detecting a direction of travel of a train on rails of a railroad track, said method comprising: comparing a characteristic of the rails based on a first frequency to the characteristic of the rails based on a second frequency to generate a comparison result, the first frequency being different than the second frequency; and determining the direction of travel of the train based on the comparison result further comprising: providing a first shunt at a first location along the rails, the first shunt being tuned to the first frequency and the second frequency; providing a second shunt at a second location along the rails, the second shunt being tuned to the first frequency; providing a third shunt at a third location along the rails, the third shunt being tuned to the second frequency, the first and second locations being on a respective side of a fourth location and the third shunt being located between the first location and the fourth location; transmitting along the rails a first signal having the first frequency and a second signal having the second frequency; measuring an impedance of the rails in relation to the first frequency; and measuring the impedance of the rails in relation to the second frequency.

7. The method of claim 6, wherein said determining step comprises determining that the train is travelling in the direction from the first location towards the fourth location if the impedance of the rails based on the first frequency is substantially similar to the impedance of the rails based on the second frequency, and that the train is travelling in the direction from the second location towards the fourth location if the impedance of the rails based on the first frequency is different than the impedance of the rails based on the second frequency.

8. A method of detecting a direction of travel of a train on rails of a railroad track, said method comprising: comparing a characteristic of the rails based on a first frequency to the characteristic of the rails based on a second frequency to generate a comparison result, the first frequency being different than the second frequency; and determining the direction of travel of the train based on the comparison result further comprising: providing a first shunt at a first location along the rails, the first shunt being tuned to the first frequency and the second frequency; providing a second shunt at a second location along the rails, the second shunt being tuned to the first frequency, the first and second locations being on a respective side of a third location; transmitting along the rails, using a first transmitter connected to the rails, a first signal having the first frequency; measuring an impedance of the rails in relation to the first frequency; and measuring the impedance of the rails in relation to the second frequency.

9. The method of claim 8, wherein the second frequency is associated with a second signal transmitted by a second transmitter connected to the rails.

10. The method of claim 8, wherein said determining step comprises determining that the train is travelling in the direction from the first location towards the third location if the impedance of the rails based on the first frequency is substantially similar to the impedance of the rails based on the second frequency, and that the train is travelling in the direction from the second location towards the third location if the impedance of the rails based on the first frequency is different than the impedance of the rails based on the second frequency.

11. A method of detecting a direction of travel of a train on rails of a railroad track, said method comprising: comparing a characteristic of the rails based on a first frequency to the characteristic of the rails based on a second frequency to generate a comparison result, the first frequency being different than the second frequency; and determining the direction of travel of the train based on the comparison result further comprising: providing a first shunt at a first location along the rails, the first shunt being tuned to the first frequency; providing a second shunt across an insulated joint at a second location along the rails, the second shunt being tuned to the second frequency, the first and second locations being on a respective side of a third location; transmitting along the rails a first signal having the first frequency and a second signal having the second frequency; measuring an impedance of the rails in relation to the first frequency; and measuring the impedance of the rails in relation to the second frequency.

12. A track circuit for a railroad track, said track circuit comprising: a constant warning time device connected to rails of the railroad track, said device being configured to detect a direction of travel of a train on the rails by: comparing a characteristic of the rails based on a first frequency to the characteristic of the rails based on a second frequency to generate a comparison result, the first frequency being different than the second frequency; and determining the direction of travel of the train based on the comparison result, further comprising: a first shunt at a first location along the rails, the first shunt being tuned to the first frequency and the second frequency; a second shunt at a second location along the rails, the second shunt being tuned to the first frequency, the first and second locations being on a respective side of a third location; a transmitter connected to the rails and adapted to transmit along the rails a first signal having the first frequency and a second signal having the second frequency; and a receiver connected to the rails and adapted to measure an impedance of the rails in relation to the first frequency and to measure the impedance of the rails in relation to the second frequency.

13. The track circuit of claim 12, wherein the direction of travel corresponds to a first direction if the comparison result indicates that the characteristic of the rails based on the first frequency behaves similarly to the characteristic of the rails based on the second frequency.

14. The track circuit of claim 13, wherein the direction of travel corresponds to a second direction if the comparison result indicates that the characteristic of the rails based on the first frequency is different than the characteristic of the rails based on the second frequency.

15. The track circuit of claim 12, wherein the characteristic of the rails is an impedance of the rails.

16. The track circuit of claim 12, further comprising a control unit adapted to determine that the train is travelling in the direction from the first location towards the third location if the impedance of the rails based on the first frequency is substantially similar to the impedance of the rails based on the second frequency and to determine that the train is travelling in the direction from the second location towards the third location if the impedance of the rails based on the first frequency is different than the impedance of the rails based on the second frequency.

17. A track circuit for a railroad track, said track circuit comprising: a constant warning time device connected to rails of the railroad track, said device being configured to detect a direction of travel of a train on the rails by: comparing a characteristic of the rails based on a first frequency to the characteristic of the rails based on a second frequency to generate a comparison result, the first frequency being different than the second frequency; and determining the direction of travel of the train based on the comparison result, further comprising: a first shunt at a first location along the rails, the first shunt being tuned to the first frequency and the second frequency; a second shunt at a second location along the rails, the second shunt being tuned to the first frequency; a third shunt at a third location along the rails, the third shunt being tuned to the second frequency, the first and second locations being on a respective side of a fourth location and the third shunt being located between the first location and the fourth location; a transmitter connected to the rails and adapted to transmit along the rails a first signal having the first frequency and a second signal having the second frequency; and a receiver connected to the rails and adapted to measure an impedance of the rails in relation to the first frequency and to measure the impedance of the rails in relation to the second frequency.

18. The track circuit of claim 17, further comprising a control unit adapted to determine that the train is travelling in the direction from the first location towards the fourth location if the impedance of the rails based on the first frequency is substantially similar to the impedance of the rails based on the second frequency, and that the train is travelling in the direction from the second location towards the fourth location if the impedance of the rails based on the first frequency is different than the impedance of the rails based on the second frequency.

19. A track circuit for a railroad track, said track circuit comprising: a constant warning time device connected to rails of the railroad track, said device being configured to detect a direction of travel of a train on the rails by: comparing a characteristic of the rails based on a first frequency to the characteristic of the rails based on a second frequency to generate a comparison result, the first frequency being different than the second frequency; and determining the direction of travel of the train based on the comparison result, further comprising: a first shunt at a first location along the rails, the first shunt being tuned to the first frequency and the second frequency; a second shunt at a second location along the rails, the second shunt being tuned to the first frequency, the first and second locations being on a respective side of a third location; a transmitter connected to the rails and adapted to transmit along the rails a first signal having the first frequency; and a receiver connected to the rails and adapted to measure an impedance of the rails in relation to the first frequency and to measure the impedance of the rails in relation to the second frequency.

20. The track circuit of claim 19, wherein the second frequency is associated with a second signal transmitted by a second transmitter associated with a second constant warning time device connected to the rails.

21. The track circuit of claim 20, further comprising a control unit adapted to determine that the train is travelling in the direction from the first location towards the third location if the impedance of the rails based on the first frequency is substantially similar to the impedance of the rails based on the second frequency, and that the train is travelling in the direction from the second location towards the third location if the impedance of the rails based on the first frequency is different than the impedance of the rails based on the second frequency.

22. A track circuit for a railroad track, said track circuit comprising: a constant warning time device connected to rails of the railroad track, said device being configured to detect a direction of travel of a train on the rails by: comparing a characteristic of the rails based on a first frequency to the characteristic of the rails based on a second frequency to generate a comparison result, the first frequency being different than the second frequency; and determining the direction of travel of the train based on the comparison result, further comprising: a first shunt at a first location along the rails, the first shunt being tuned to the first frequency; a second shunt provided across an insulated joint at a second location along the rails, the second shunt being tuned to the second frequency, the first and second locations being on a respective side of a third location; a transmitter connected to the rails and adapted to transmit along the rails a first signal having the first frequency and a second signal having the second frequency; and a receiver connected to the rails and adapted to measure an impedance of the rails in relation to the first frequency and measure the impedance of the rails in relation to the second frequency.

* * * * *